US010519681B1

(12) United States Patent
Jacobs

(10) Patent No.: US 10,519,681 B1
(45) Date of Patent: Dec. 31, 2019

(54) MAIN DRAIN OUTLET FOR A SWIMMING POOL

(71) Applicant: Bob Jacobs, Myrtle Beach, SC (US)

(72) Inventor: Bob Jacobs, Myrtle Beach, SC (US)

( * ) Notice: Subject to any disclaimer, the term of this patent is extended or adjusted under 35 U.S.C. 154(b) by 0 days.

(21) Appl. No.: 16/193,111

(22) Filed: Nov. 16, 2018

(51) Int. Cl.
*E04H 4/12* (2006.01)

(52) U.S. Cl.
CPC ..... *E04H 4/1236* (2013.01)

(58) Field of Classification Search
CPC ..... E04H 4/1236
USPC ..... 4/507
See application file for complete search history.

(56) References Cited

U.S. PATENT DOCUMENTS

2007/0061957 A1* 3/2007 Meincke ..... E04H 4/1236 4/507
2007/0180605 A1* 8/2007 Griffin ..... E04H 4/1236 4/507

* cited by examiner

*Primary Examiner* — Tuan N Nguyen
(74) *Attorney, Agent, or Firm* — Witters & Associates; Steve Witters

(57) ABSTRACT

A unitary main drain suction outlet for a swimming pool and outlet system is presently disclosed. The unitary main drain suction outlet has a water inlet comprising a sole slot opening, a water flow through portion disposed between the water inlet and a water exit. The water flow through portion is void of a sump and configured for the flow through of water from the water inlet to the water exit. The water inlet and the water flow through portions are configured for the flow through of water substantially in a linear direction from the water inlet toward the water exit.

20 Claims, 7 Drawing Sheets

MAIN DRAIN OUTLET FOR A SWIMMING POOL

FIELD OF THE DISCLOSURE

This disclosure relates to unitary main drain suction outlets for swimming pools, and more specifically to main drain outlets that may reduce safety hazards associated with main drain outlets of the prior art.

BACKGROUND

Pool water sanitation systems are configured to sanitize water by pumping the water from the swimming pool water body and water floor, and recycle the same through a filter and back to the water body. Suction outlets, in flow communication with a filter pump, interface with the water body that bathers occupy. These suction outlets typically comprise two main or more spaced drains, or main drains, located in the floor of the deep portion of the swimming pool. The primary purpose of the main drains is to transfer the water to the filter.

In the prior art, the main drains typically comprise an assembly that includes a grate-like cover that interfaces with the pool water body, with a sump positioned below the cover for a main drain suction line to terminate into, thereby creating a smaller body of pool water, or sump, that will be in direct contact with the suction forces of the main drain suction line. The water flowing in the sump may cause hair, clothing, or jewelry to become tangled with or below the grate and may hold a bather underwater. These grate-like covers may be raised with respect to an inner floor of the swimming pool and may also introduce tripping and kicking hazards.

There are many safety hazards associated with the pool water sanitation systems of the prior art. Suction safety hazards may include entrapment, evisceration, and entanglement of human hair, clothing, and jewelry, for example. Also, the main drain assemblies of the prior art typically comprise component parts. These component parts may come apart, introducing safety hazards to the pool with the pool water sanitation system. For example, the grate-like covers may be removed or broken, increasing potential entanglement and suction safety hazards for swimming pool users.

Suction main drain outlets are governed by codes and standards. For example, fully submerged suction outlet fitting assembly(ies), including cover/grate and associated fittings, fasteners and components may need be tested and certified by a third-party. Suction-limiting systems and "backup" systems may be required for protecting against body entrapment, evisceration, limb, hair, and mechanical hazards. Sumps may be required to meet specification or regulatory requirements. Blockable and unblockable outlets may need to meet regulatory or design criteria. For example, dual outlets may be required to be separated by a minimum of 3 feet.

SUMMARY

In one aspect of the present disclosure, a unitary main drain suction outlet for a swimming pool is disclosed. The unitary main drain suction outlet has a water inlet comprising a sole slot opening configured to be disposed substantially flush with a floor of the swimming pool. A water flow through portion is disposed between the water inlet and a water exit, the water flow through portion is void of a sump and configured for the flow through of water from the water inlet to the water exit. The water exit has a rounded opening configured to join with an exit line or pipe. The water inlet and the water flow through portions are configured for the flow through of water substantially in a linear direction from the water inlet to the water exit.

In another aspect of the present disclosure, a suction outlet system for a swimming pool is disclosed. The suction outlet system for a swimming pool comprises a first unitary main drain and a second unitary main drain. The first unitary main drain comprises a first water inlet comprising a sole slot opening configured to be disposed substantially flush with a floor of the swimming pool; a first water flow through portion disposed between the first water inlet and a first water exit, the first water flow through portion being void of a sump and configured for the flow through of water from the first water inlet toward the first water exit; and wherein the first water inlet and the first water flow through portion are configured for the flow through of water substantially in a linear direction from the first water inlet toward the first water exit. The second unitary main drain comprises a second water inlet comprising a sole slot opening configured to be disposed substantially flush with a floor of the swimming pool; a second water flow through portion disposed between the second water inlet and a second water exit, the second water flow through portion being void of a sump and configured for the flow through of water from the second water inlet toward the second water exit; and wherein the second water inlet and the second water flow through portion are configured for the flow through of water substantially in a linear direction from the second water inlet toward the second water exit. The suction outlet system further comprises a system water exit in flow communication with the first water exit and the second water exit, the system water exit being configured to join with an exit line or pipe.

In a further aspect, a suction outlet for a swimming pool comprises a concrete form having a first sidewall and a second sidewall. The first sidewall is spaced from the second sidewall their edges joined together, forming a water flow through portion having sole slot inlet therebetween. An exit is in flow communication with the sole slot inlet and the water flow through portion. The sole slot inlet and the water flow through portion are configured and disposed to provide a substantially non-vortexing flow of water from a floor of the swimming pool, upon a suction being placed on the water flowing through the suction exit. At least one flange extends from the sidewalls configured to become embedded in a poured concrete floor of the swimming pool.

BRIEF DESCRIPTIONS OF THE DRAWINGS

The following figures, which are idealized, are not to scale and are intended to be merely illustrative of aspects of the present disclosure and non-limiting. In the drawings, like elements may be depicted by like reference numerals. The drawings are briefly described as follows.

Figure 8A:
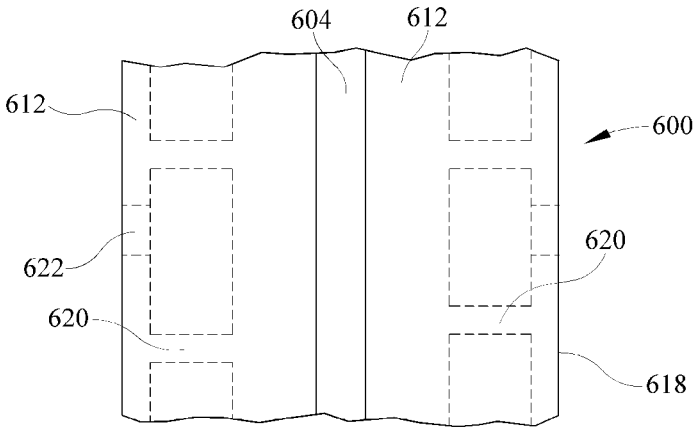
Figure 8B:
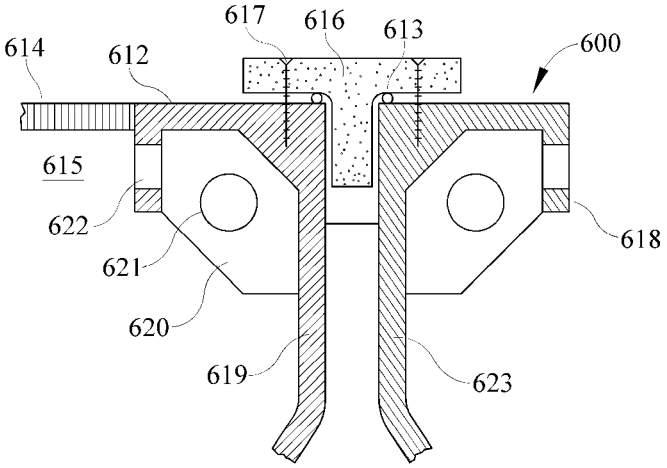
Figure 8C:
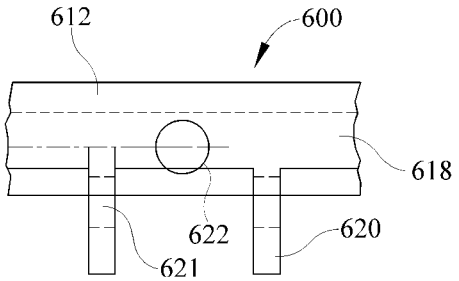
Figure 9A:
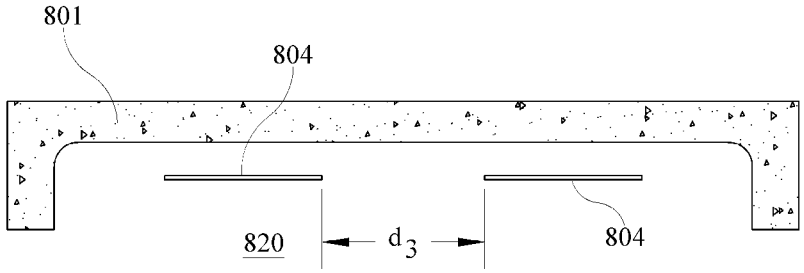
Figure 9B:
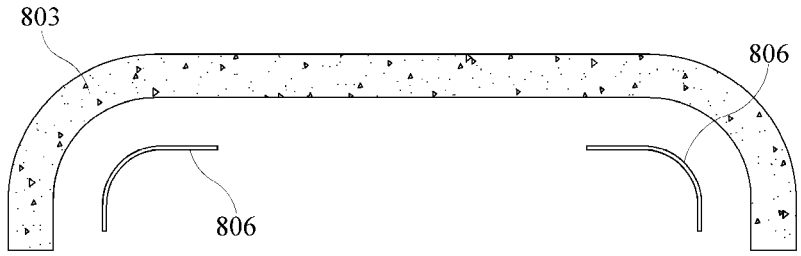

FIGS. 8A, 8B, and 8C show a top, cross-sectional, and side view of a portion of a unitary main drain suction outlet of the present disclosure that may be advantageous for installation in a poured swimming pool floor;

FIG. 9A is an illustrative top view of an installed unitary main drain suction outlet system of the present disclosure having linear slot openings and disposed substantially within a floor of a swimming pool; and FIG. 9B is an illustrative top view of an installed unitary main drain suction outlet system of the present disclosure having longitudinally curved slot openings and disposed substantially within a floor of a swimming pool.

DETAILED DESCRIPTION

Figure 1A:
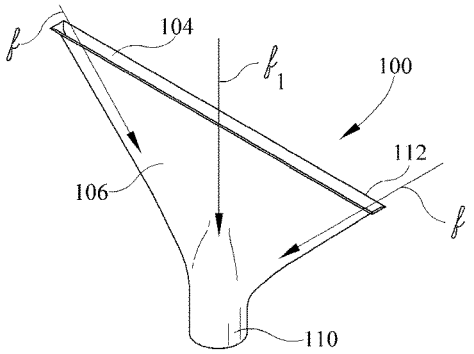
FIG. 1A is a perspective view of an illustrative example of the unitary main drain suction outlet for a swimming pool of the present disclosure showing water flow through directional lines.
Figure 1B:
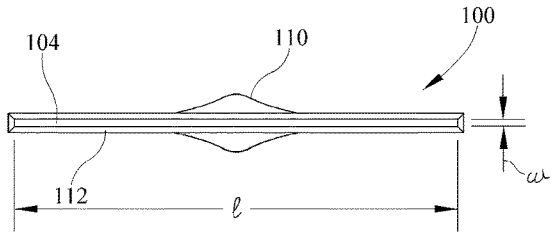
FIG. 1B is a top view of the unitary main drain suction outlet for a swimming pool of FIG. 1A showing illustrative dimensions.
Figure 1C:
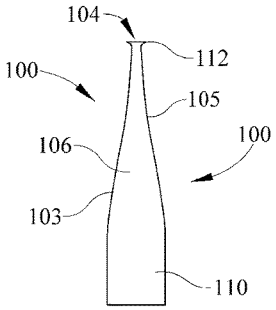
FIG. 1C is an end view of the unitary main drain suction outlet for a swimming pool of FIG. 1A.
Figure 1D:
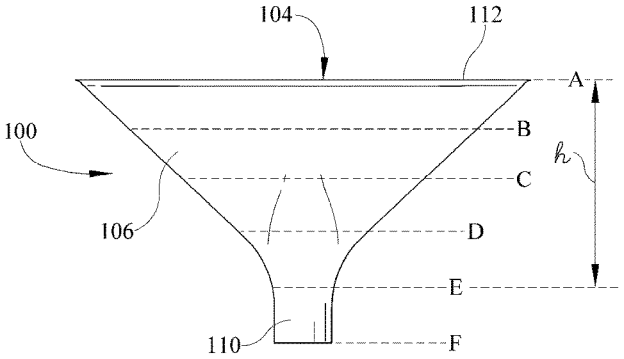
FIG. 1D is a side view of the unitary main drain suction outlet for a swimming pool of FIG. 1A showing illustrative dimensions.

FIGS. 1A, 1B, 1C, and 1D show an embodiment of a unitary main drain suction outlet 100 for a swimming pool. Specifically, FIGS. 1A, 1B, and 1C respectively show a perspective, a top view, and an end view of the unitary main drain suction outlet 100. FIG. 1D is a side view of unitary main drain suction outlet 100 showing cross-sectional area lines A-F.

Unitary main drain suction outlet 100 is configured to be an outlet for water in a swimming pool. In at least one embodiment of the unitary main drain suction outlet of the present disclosure, unitary main drain suction outlet 100 comprises a water inlet 104 comprising a sole slot opening configured to be disposed substantially flush with a floor of the swimming pool. A water flow through portion 106 is disposed between water inlet 104 and a water exit 110. Water flow through portion 106 may be void of a sump. Water exit 110 may have an opening configured to join with an exit line or pipe. In at least one embodiment, water exit 110 has a flow through axis, or plane, in-line with a flow through axis of water inlet 104 and water flow though portion 106.

Water flow through portion 106 is configured for the flow through of water from water inlet 104 to the water exit 110. Water flow through portion 106 may be configured and disposed to provide substantially non-vortexing flow through of water from the swimming pool. In at least one embodiment, water inlet 104 and water flow through portion 106 are configured for the flow through of water substantially in a linear direction from the water inlet toward water exit 110. For example, unitary main drain suction outlet 100 may be configured to provide a flow through of water in a general direction as indicated with directional arrows f and Water flow through portion 106 may have a first sidewall 103 and a second sidewall 105 extending from proximate water inlet 104 to proximate water exit 110, having outer edges, joined or sealed together. In at least one embodiment, the sidewalls each have an equivalent triangular shape with an edge disposed with, or proximate, a sole slot opening or water inlet 104. For example, a gap space between top edges of the sidewalls may form sole slot opening 104.

Water exit 110 comprises a rounded opening configured to join with an exit pipe. Unitary main drain suction outlet 100 may comprise a flange 112 extending outwardly from water inlet 104. Flange 112 may be configured to be disposed substantially flush with a floor of a swimming pool. In at least one embodiment, flange 112 is configured to be in a poured floor of a swimming pool.

Water flow through portion 106 may be configured and disposed to provide substantially non-vortexing flow through of water from the swimming pool at an increasing flow velocity or at a substantially constant flow velocity, from water inlet 104 to water exit 110. For example, water flow through portion 106 may have a section tapered inwardly about its central flow through axis "$f_1$" as shown in FIGS. 1A-1D.

Water inlet 104 may have a selected length "l" and a selected width "w" for providing desired characteristics or functionality of unitary main drain suction outlet 100. Length "l" and width "w" may be selected to provide a desired flow through cross-sectional area of water inlet 104 and/or a desired mitigation of one or more hazards associated with suction drains. For example, length "l" may be at least 3 feet or more which may mitigate one or more hazards associated with entrapment, evisceration, and entanglement of human hair, clothing, and jewelry. In at least one embodiment, length "l" is between about 3 feet and about 4 feet. For example, length "l" may be about 38 inches. It is to be understood that length "l" is not limited with the present disclosure and may be greater than 4 feet or less than 3 feet, in increments of a fraction of an inch.

Width "w" may be selected to provide a desired characteristics or functionality of unitary main drain suction outlet 100. For example, width "w" may be may be less than 1 inch which may mitigate one or more hazards associated with entrapment, evisceration, and entanglement of human hair, clothing, and jewelry. In at least one embodiment, width "w" may be about a five eighths inch, half an inch, or about a quarter inch or less. It is to be understood that width "w" is not limited with the present disclosure and may be less than an inch or more than an inch, in increments of a fraction of an inch.

FIG. 1D is a side view of unitary main drain suction outlet 100 showing cross-sectional area lines A-F. The inner cross-sectional area of unitary main drain suction outlet 100 may be referenced as $X_A$, $X_B$, $X_C$, $X_D$, $X_E$, $X_F$, at each cross-sectional area line A-F. For example, $X_A$ may reference the inner cross-sectional area, of unitary main drain suction outlet 100, at cross-sectional line A or proximate inlet 104. Water exit 110 has inner cross-sectional area $X_F$.

It is known that, at a given flow rate in gallons per minute, a smaller cross-sectional area will provide a higher flow through velocity than a larger cross-sectional area. Main drains for swimming pools typically have a sump which incorporates an enlarged cross-sectional area or volume, allowing for a slowing of flow through velocity and a tendency for vortexing, which may increase entanglement hazards of clothing and jewelry.

In at least one embodiment of the present disclosure, unitary main drain suction outlet 100 is void of a sump or any substantial slowing of flow through velocity. For example, flow through portion 106 may be configured to provide a substantially consistent or increasing flow through velocity. In at least one embodiment, first cross-sectional area $X_A$ is greater than or equal to cross-sectional area $X_B$. In at least one other embodiment of unitary main drain suction outlet 100, $X_A \geq X_B \geq X_C \geq X_D$. In at least one additional embodiment of unitary main drain suction outlet 100 $X_A \geq X_B \geq X_C \geq X_D \geq X_E \geq X_F$.

In at least one embodiment of unitary main drain suction outlet 100, the second cross-sectional area of flow through portion 106 decreases from proximate the first cross-sectional area $X_A$ to proximate cross-sectional area $X_E$. For example, in at least one embodiment $X_A > X_B > X_C > X_D > X_E$. In at least one further embodiment of unitary main drain suction outlet 100, flow through portion 106 may have an upper portion with a cross-sectional area that linearly decreases from proximate the first cross-sectional area $X_A$, to proximate cross-sectional area $X_E$. For example, cross-sectional lines A-E may be equally spaced and cross-sectional area $X_A$ may be greater than cross-sectional area $X_B$ by the same amount as $X_B$ is greater than $X_C$ and the same amount as $X_C$ is greater than $X_D$.

In at least one additional embodiment of unitary main drain suction outlet 100, the cross-sectional areas of a portion of flow through portion 106 are substantially equivalent, configuring main drain 100 to provide an upper portion with substantially constant or consistent flow through velocity through. For example, the cross-sectional areas may be described as $X_A \approx X_B \approx X_C \approx X_D$, or even $X_A \approx X_B \approx X_C \approx X_D \approx X_E \approx X_F$.

Flow through portion 106 may have a height "h". Height "h" may be selected to mitigate one or more hazards associated with entrapment, evisceration, or entanglement of human hair, clothing, or jewelry by spacing water inlet 104 from water outlet 110. Height "h" may be selected to provide for installation techniques. For example, in new construction, swimming pool floors are often poured. Poured concrete or concrete and plaster swimming pool floors may be about 6 inches thick. In at least one embodiment, unitary main drain suction outlet 100 is configured as a concrete form. For example, height "h" may be at least 6 inches. This may provide for the encasement of flow through portion 106 in a poured swimming pool floor and access to water exit 110, extending below the poured floor. Flange 112 may be configured and disposed to become in line with the plane of a swimming pool floor and may aid in installation of unitary main drain suction outlet 100.

Figure 2A:
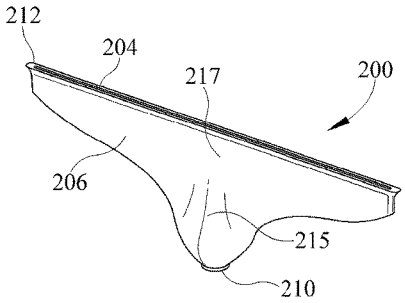
FIG. 2A is a perspective view of another illustrative example of the unitary main drain suction outlet for a swimming pool of the present disclosure.
Figure 2B:
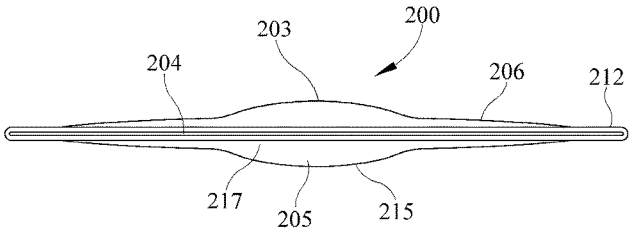
FIG. 2B is a top view of the illustrative example of the unitary main drain suction outlet for a swimming pool shown in FIG. 2A.
Figure 2D:
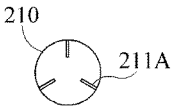
FIGS. 2D-2F show an illustrative example of a flow blade system that may be incorporated with the unitary main drain suction outlet of the present disclosure.
Figure 2E:
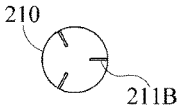
Figure 2F:
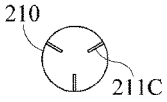

FIGS. 2A-2F show unitary main drain suction outlet 200 for a swimming pool of the present disclosure. Specifically, FIGS. 2A, 2B, and 2C respectively show a perspective view, a top view, and a cross-sectional side view of the unitary main drain suction outlet 200. FIGS. 2D-2F show an example of a flow blade arrangement of the present disclosure.

Unitary main drain suction outlet 200 is configured to be an outlet for water in a swimming pool. FIG. 2B is a cross-sectional side view of unitary main drain suction outlet 200 showing cross-sectional area lines $B_2$-$E_2$. In at least one embodiment of the unitary main drain suction outlet of the present disclosure, unitary main drain suction outlet 200 comprises a water inlet 204 comprising a sole slot opening configured to be disposed substantially flush with a floor of the swimming pool. A water flow through portion 206 is disposed between water inlet 204 and water exit 210. Water flow through portion 206 is configured for the substantially non-vortexing flow through of water from water inlet 204 to proximate water exit 210.

Water exit 210 may comprise a round or rounded opening configured to join with an exit pipe. Unitary main drain suction outlet 200 may comprise a flange 212 extending outwardly from water inlet 204. Flange 212 may be configured to be disposed substantially flush with a floor of a swimming pool. Water inlet 204 may comprises a sole slot opening.

Water flow through portion 206 may be configured and disposed to provide substantially non-vortexing flow through of water from the swimming pool. For example, unitary main drain suction outlet 200 may be void of a sump or configured to provide a non-slowing velocity of the flow of water therethrough.

Water flow through portion 206 may comprise an upper portion 217 and a lower portion 215. In at least one embodiment, unitary main drain suction outlet 200 is configured to provide water flow at a substantially constant flow velocity, at an increasing flow velocity, or portions having either a substantially constant flow velocity or an increasing flow velocity, from water inlet 204 to water exit 210. For example, upper portion 217 of flow through portion 206 may be configured to provide a substantially constant flow velocity proximate water inlet 204. Lower portion 215 may be configured to provide a substantially constant velocity or an increasing velocity toward outlet 210. In at least one embodiment, lower portion 215 has outwardly extending sidewalls, 203 and 205, and inwardly extending edges. The cross-sectional areas taken at different points in lower portion 215 may be substantially equivalent. For example, the cross-sectional area taken at $D_2$ may be substantially equivalent to the cross-sectional area taken at $E_2$, thus configuring lower portion 215 to provide a flow portion for a flow of substantially consistent velocity.

Figure 2C:
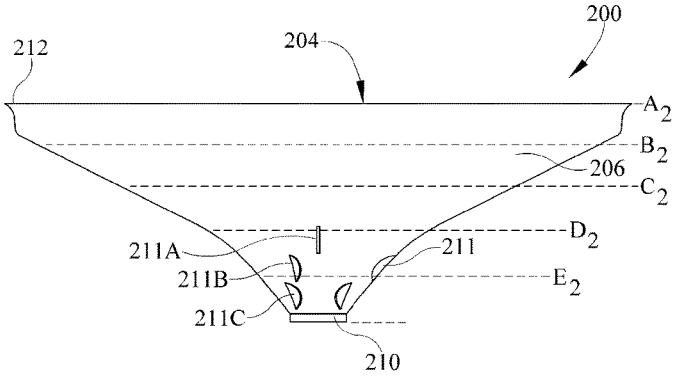
FIG. 2C is a cross-sectional side view of the unitary main drain suction outlet for a swimming pool of FIG. 2A showing a flow blade system.

FIG. 2C is a cross-sectional side view of unitary main drain suction outlet 200 showing cross-sectional area lines $A_2$, $B_2$, $C_2$, $D_2$ and $E_2$. In at least one embodiment of unitary main drain suction outlet 200, water inlet 204 has an inlet cross-sectional area at cross-sectional area line $A_2$ and water flow through portion 206 has equivalently spaced cross-sectional areas at cross-sectional area line $B_2$, $C_2$, $D_2$ and $E_2$, referred to as cross-sectional areas $A_2$, $B_2$, $C_2$, $D_2$ and $E_2$.

In at least one embodiment of unitary main drain suction outlet 200, cross-sectional areas $A_2$, $B_2$, $C_2$, $D_2$ and $E_2$ are not increasing from inlet 204 toward outlet 210. For example, the cross-sectional areas may have dimensions wherein $A_2 \geq B_2 \geq C_2 \geq D_2 \geq E_2$. In at least one other embodiment of unitary main drain suction outlet 200, at least a portion of flow through portion 106 has a cross-sectional area decreasing from inlet 204 toward outlet 210. For example, $B_2$ may be greater than $C_2$. In at least one further embodiment of unitary main drain suction outlet 200, the cross-sectional area of a portion of flow through portion 206 linearly decreases from inlet 204 toward outlet 210. For example, $C_2$ may be greater than $D_2$ by the same amount that $B_2$ is greater than $C_2$. In at least one additional embodiment of unitary main drain suction outlet 200, the cross-sectional area of a portion of flow through portion 206 remains substantially constant from inlet 204 toward outlet 210. For example, at least one of $A_2 \approx B_2$, $B_2 \approx C_2$, $C_2 \approx D_2$ and $D_2 \approx E_2$ may be representative of the structure of unitary main drain suction outlet 200. In at least one other embodiment, upper portion 217 may be configured to provide a substantially constant flow through velocity, ex. $A_2 \approx B_2$, and lower portion 215 may be configured to provide a portion having a substantially constant flow through velocity, ex. $B_2 \approx C_2$, or an increasing flow through velocity, ex. $B_2 > C_2$, In at least one embodiment of the unitary main drain suction outlet of the present disclosure, flow blades 211 extend inwardly from an inner surface of unitary main drain suction outlet 200. For example, unitary main drain suction outlet 200 may comprise one or more sets of flow blades 211 which may be disposed in or proximate water exit 210, as shown in FIGS. 2D-2F. In at least one embodiment of the unitary main drain suction outlet of the present disclosure, unitary main drain suction outlet 200 comprises three sets of flow blades, 211A, 211B, and 211C. Each set of flow blades may be disposed in lower portion 215. Each set of flow blades may have a plurality of flow blades substantially equally spaced about an inner perimeter of unitary main drain suction outlet 200. For example, flow blade sets 211A, 211B, and 211C may each have three blades spaced about 60° apart from one another. Each set of flow blades may be axially offset from an adjacent set of flow blades or the other sets of flow blades. For example, flow blade set 211A may be axially offset from flow blade set 211B, which may be axially offset from flow blade set 211C.

Unitary main drain suction outlet 200 may comprise flow blades 211 extending inwardly from lower portion 215 of flow through portion 206. Flow blades 211 may be disposed at levels and the levels of flow blades may be axially offset with respect to the flow through axis of unitary main drain suction outlet 200. For example, flow blades 211A may be at a first level, flow blades 211B may be at a second level, and flow blades 211C may be at a third level. In the embodiment shown in FIGS. 2D-2F, flow blades 211 at each level are axially offset from an adjacent level. It is to be understood that flow blades 211 may be optional and may be disposed at most any configuration which may decrease any tendency for vortexing, or promote laminar flow, of water flowing through the unitary main drain suction outlet of the present disclosure.

Figure 3A:
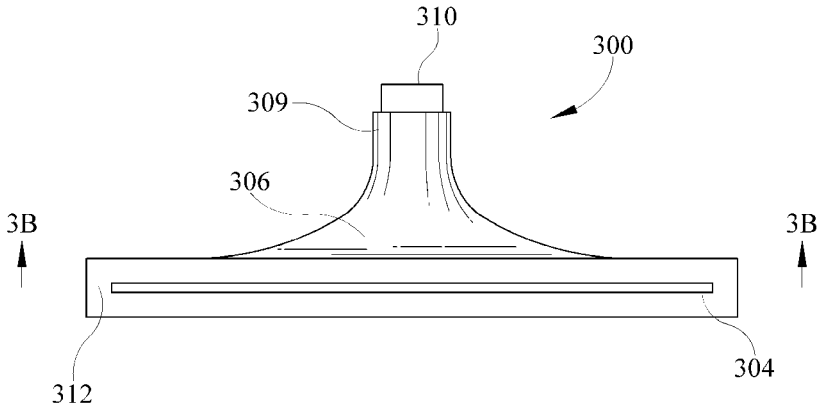
FIG. 3A is a top view of an illustrative example of a unitary main drain suction outlet for a swimming pool of the present disclosure having a curved flow through portion.
Figure 3B:
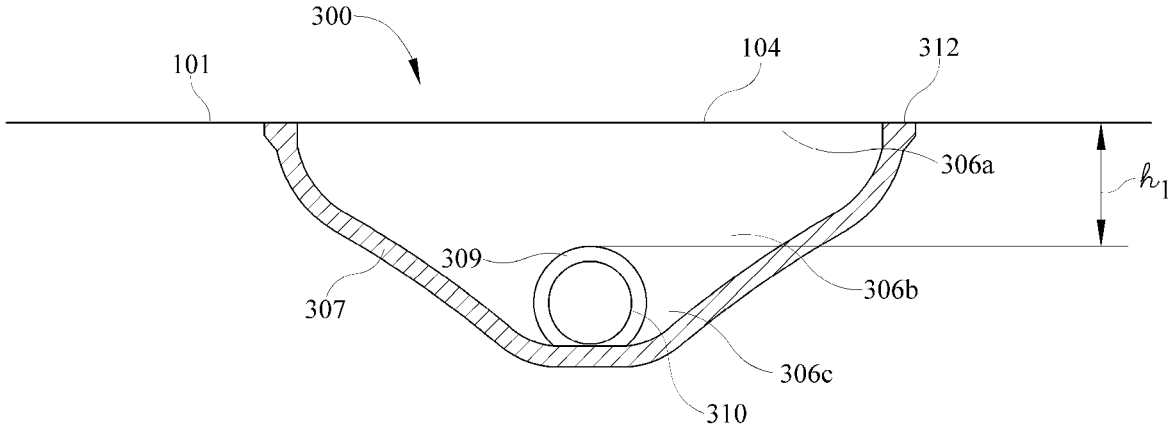
FIG. 3B is a cross-sectional view of the unitary main drain suction outlet of FIG. 3A taken along sectional lines 3B-3B.

FIG. 3A is a top view of unitary main drain suction outlet 300 and FIG. 3B shows a cross-sectional view of unitary main drain suction outlet 300 taken along sectional lines 3B-3B of FIG. 3A. Unitary main drain suction outlet 300 comprises an inlet 304 comprising a sole slot opening configured to be disposed substantially flush with a floor of a swimming pool. Water flow through portion 306 is disposed between sole slot opening 304 and exit 310 and is configured for the flow through of water from sole slot opening 304 to exit 310. Water flow through portion 306 is configured and disposed to provide substantially non-vortexing flow through of water from the swimming pool at an increasing flow velocity, a substantially constant flow velocity, or portions having an increasing flow velocity and portions having a substantially constant flow velocity, from sole slot opening 304 to exit 310. Exit 310 is configured to join with an exit line or pipe.

In at least one embodiment of the unitary main drain suction outlet of the present disclosure, a water inlet has a flow through axis that is not in line with a flow through axis of a water exit. For example, FIGS. 3A and 3B show unitary main drain suction outlet 300 comprising an exit 310 with a flow through axis that is not in line with a flow through axis of sole slot opening 304. In the example shown in FIGS. 3A and 3B, water exit 310 has a flow through axis perpendicular with a flow through axis of sole slot opening 304. Sole slot opening 304 is flat and configured to be disposed substantially flush with a floor of the swimming pool. Sole slot opening 304 may have a flange or thickened portion 312 configured to be disposed in an inner floor of the swimming pool. This configuration may be advantageous for an embodiment of the present disclosure wherein the unitary main drain suction outlet may be a form for pouring a floor about the outlet, such as in new construction. For example, height "$h_1$" may be at least 6 inches which may approximate a depth of a poured pool floor. Outlet 310 may extend under a poured floor and flange 312 may be incorporated within a plane of the swimming pool floor.

Flow through portion 306 has outer portion 306*a*, middle portion 306*b*, inner portion 306*c*, and exiting portion 309. In at least one embodiment, flow through portion 306 is configured for a flow through velocity through outer portion 306*a* less than or equal to a flow through velocity through exiting portion 309. In at least one other embodiment, flow through portion 306*a* is configured for a flow through velocity less than or equal to a flow through velocity through portion 306*b* and flow through portion 306*b* is configured for a flow through velocity less than or equal to a flow through velocity through portion 306*c*.

Figure 4:
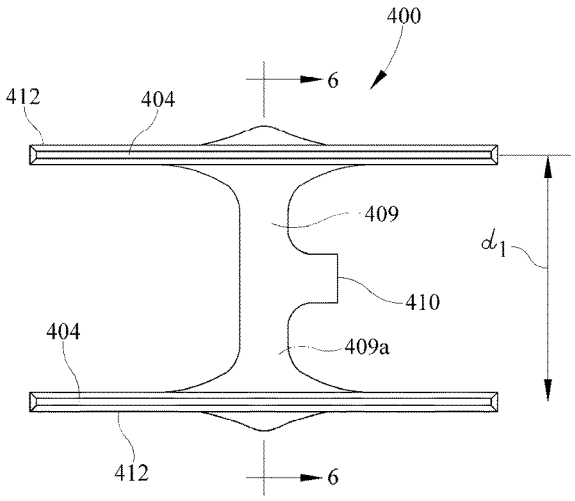
FIG. 4 is a top view of an illustrative example a unitary main drain suction outlet system for a swimming pool of the present disclosure having two water inlets.
Figure 6:
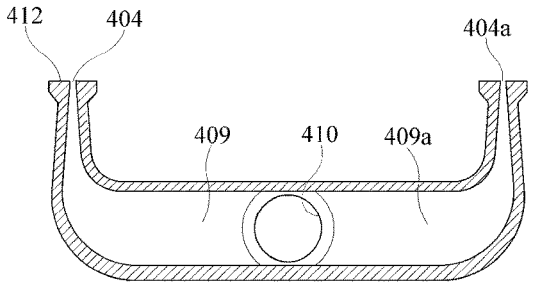
FIG. 6 is a cross-sectional view of the unitary main drain suction outlet of FIG. 4 taken along sectional lines 6-6.

FIG. 4 shows a top view unitary main drain suction outlet system 400 and FIG. 6 is a cross-sectional view of the unitary main drain suction outlet system 400 taken along sectional lines 6-6. Unitary main drain suction outlet system 400 is unitary and has a first water inlet 404 and a second water inlet 404*a*. Having more than a single inlet may be desirable for larger swimming pools and may be required to meet recreational water codes. For example, first water inlet 404 and second water inlet 404*a* may be separated by a distance "d1". Distance "d1" may be a distance for mitigating body entrapment, for example "d1" may be 3 feet or more.

First water inlet 404 and second water inlet 404*a* each comprise a sole slot opening configured to be disposed substantially flush with a floor of the swimming pool. A flange, or outwardly extending portion, 412 may extend outwardly from water inlets 404 and 404*a* and may be configured to be disposed substantially flush with a floor of a swimming pool. First water inlet 404 and second water inlet 404*a* are in flow communication with a first and second water flow through portions 409 and 409*a*, respectively. First water inlet 404 and second water inlet 404*a*, together, have a combined first cross-sectional area. First and second water flow through portions 409 and 409*a* are in flow communication with each other and water exit 410. First and second water flow through portions 409 and 409*a* are configured for the flow through of water from first water inlet 404 and second water inlet 404*a* to water exit 410.

In at least one embodiment, the combined first cross-sectional area is greater than or equal to a cross-sectional flow through area of exit 410. Exit 410 may have a rounded opening configured to join with an exit line or pipe. Flow through portions 409 and 409*a* may be configured for non-vortexing therethrough to exit 410.

Figure 5:
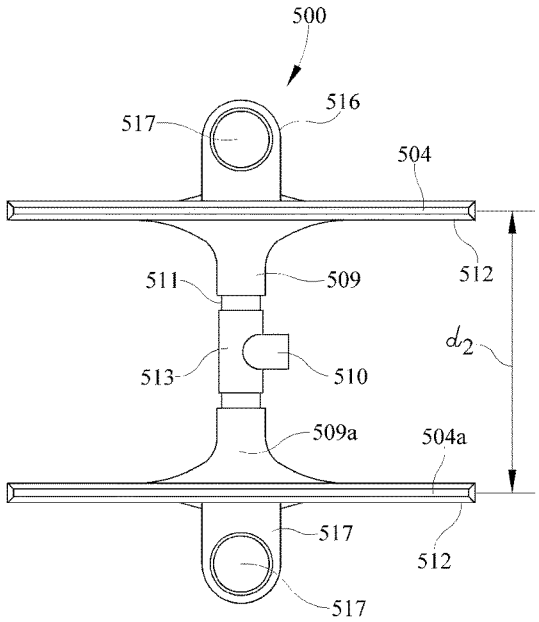
FIG. 5 is a top view of another illustrative example of a main drain suction outlet system for a swimming pool of the present disclosure having two water inlets.

FIG. 5 shows a top view of main drain suction outlet assembly system 500 configured to drain water from a swimming pool. Main drain suction outlet assembly system 500 comprises a first water inlet 504 and a second water inlet

504*a*. A flange, or outwardly extending portion, 512 may extend outwardly from water inlets 504 and 504*a* and may be configured to be disposed substantially flush with a floor of a swimming pool. Water inlets 504 and 504*a* are in flow communication with each other and water exit 510. Such a configuration may be desirable for larger swimming pools. Flow communication between the first and second water inlets 504 and 504*a* may be provided with a "T" connector 513. "T" connector 513 is configured to join with connecting or extension pipes 511. "T" connector 513 has water exit 510. Connecting pipes 511 may be of similar length to provide substantially similar flow through each water inlet 504 and 504*a*. However, it is to be understood that connecting pipes 511 may be most any desired length to provide desired spacing between inlets 504, such as "d2". Distance "d2" may be a distance for mitigating body entrapment, for example "d2" may be 3 feet or more.

Each water inlet 504 and 504*a* has an inlet slot with a longitudinal axis substantially greater than a latitudinal axis and are configured to be disposed substantially flush with a floor of the swimming pool. Exit 510 has a rounded opening configured to join with an exit line or pipe. Water flow through sections 509 and 509*a* are configured for the non-vortexing flow through of water from the inlets 504 and 504*a* and toward exit 510. Water flow through sections 509 and 509*a* may have a portion tapered inwardly about longitudinal ends of sidewalls extending from inlets 404 and 404*a*. Unitary main drain suction outlet 500 is configured to provide a flow through of water therethrough at an increasing flow through velocity, at a substantially constant or consistent flow through velocity, or portions providing an increasing flow through velocity and portions providing at a substantially constant flow through velocity, from its inlets 504 and 504*a* to exit 510.

In at least one aspect, main drain suction outlet system 500 has an access ports 516 configured and disposed to provide access to flow through portions 509 and 509*a*, for cleaning. Access ports 516 extend from flow through portions 509 and 509*a* and are centrally disposed with respect to the axial length of inlets 504 and 504*a*. Access ports 516 have openings covered with a removable access port covers 517. Removable access port covers 517 are configured to be disposed substantially within an inner floor of a swimming pool. Removal of access port covers 517 allows access to flow through portions 509 and 509*a*, through access ports 516.

Figure 7:
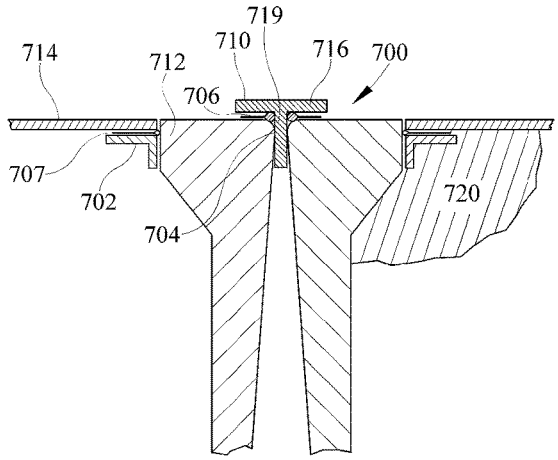
FIG. 7 is a cross-sectional illustration of an installed unitary main drain suction outlet of the present disclosure showing a test strip sealing engaging a slot opening inlet.

FIG. 7 shows a cut-away cross-sectional view of a portion of installed water outlet 700 having test strip sealing 716 engaging water inlet 704. Test strip 716 has a "T" cross-sectional configuration with a leg 719 extending into water inlet 704, which is in the form of a slot orifice. Outwardly extending portions 710, of test strip 716, extend outwardly toward flange 712. Test strip 716 is sealing engaging water inlet 704 with gasket 706. Gasket 706 may be a bulb gasket having a rounded surface proximate water inlet 704 and a tail extending outwardly toward flange 712. Other gaskets, as are known in the art, may be used to form a seal between test strip 716 and water inlet 704. For example, bulb seals manufactured by Simolex Rubber Corp., Plymouth, Mich., may provide a seal for test strip 716. In at least one aspect, a test strip 716 may be provided for each orifice in the water outlet of the present disclosure. For example, one test strip 716 may sealingly engage a first water inlet and another test strip 716 may sealingly engage a second water inlet.

Test strip 716, in conjunction with gasket 706, is configured and disposed to provide a seal between water inlet 704 and removable test strip 716 with a seal sufficient to leak test water outlet 700. Leak testing may be performed after installation of water outlet 700 but prior to construction of the swimming pool. Leak testing may be accomplished by pumping water into water outlet 700 and purging air from the system. The pressure may be maintained in the system during construction of the swimming pool. For example, maintaining water pressure in water outlet 700 may aid in maintaining the shape of water outlet 700 while a concrete floor, or concrete encasement, of the swimming pool is poured and set.

Test strip(s) 716 may be removably secured or fastened to water outlet 700 prior to shipping from a manufacturing facility and may remain in place during construction of the swimming pool. Leg 719 may extend into a portion of water inlet 704 which may aid in maintaining the shape of water inlet 700 during shipment and/construction or installation. For example, test strip(s) 716 may prevent debris from entering inlet 704 during construction.

Construction and installation may include positioning water outlet 700 to provide water inlet 704, or flanges 712, to become embedded in a plane of the swimming pool floor. Upon positioning water outlet 700, concrete, plaster, or layers of concrete and plaster, poured floor 720, may be poured about water outlet 700. Angles 702 and a pool liner 714 may be then be put into place to form a swimming pool floor having a sole slot opening therein, formed with inlet 704. Angles 702 and gaskets 707, map be placed upon pouring of poured floor 720 and prior to placing liner 714 on poured floor 720.

FIGS. 8A, 8B, and 8C show a top, cross-sectional, and side view, respectively, of a portion of a unitary main drain suction outlet 600. Unitary main drain suction outlet 600 may be advantageous for installation in a poured floor of a swimming pool. FIG. 8B shows a cut-away cross-sectional view of a portion of an installed unitary main drain suction outlet of the present disclosure having sealing strip 616 sealing engaging water inlet 604. Sealing strip 616 has a "T" cross-sectional configuration with a leg extending into water inlet 604 and legs extending outwardly, the outwardly extending flanges may be secured to flange 612 with fasteners 617. Sealing strip 616 may sealing engage water inlet 604 and may have a gasket 613 between sealing strip 616 and unitary main drain suction outlet 600. Sealing strip 616 may be installed during manufacture and may be held within water inlet 604 during installation and may be used for leak testing unitary main drain suction outlet 600.

Unitary main drain suction outlet 600 may be configured for installation into a poured floor of a swimming pool. For example, unitary main drain suction outlet 600 may have an outwardly extending flange 612, extending outwardly from water inlet 604, configured to be disposed in a plane of a poured floor of a swimming pool, such as a plaster coat 614 or concrete 615. Unitary main drain suction outlet 600 may have downwardly extending flange 618 extending downwardly from outwardly extending flange 612. Downwardly extending flange 618 may be configured to be disposed in the floor of a swimming pool, such as to extend into plaster coat 614 and/or concrete 615. Unitary main drain suction outlet 600 may have brackets 620 extending from outwardly extending flange 612, downwardly extending flange 618, and a sidewall 619 or 623. Downwardly extending flange 618 may have apertures 622 and brackets 620 may have apertures 621. Apertures 621 and 622 may provide for the flow through of a poured floor, such as concrete.

In at least one embodiment, unitary main drain suction outlet 600 may be a concrete form. For example, unitary main drain suction outlet 600 may have its outlet placed in flow communication with an outlet pipe and positioned to extend upward from a sub grade of sand and/or gravel. A concrete floor 615 may be poured on the sub grade and about unitary main drain suction outlet 600. A plaster coat 614 may be poured onto concrete floor 615. The concrete may flow into apertures 621 and 622. Sealing strip 616 may provide a resistance to collapse of inlet 604 during installation of suction outlet 600. Flanges 612 and 618 and brackets 620 may provide for integration of unitary main drain suction outlet 600 with the poured swimming pool floor. The integration of unitary main drain suction outlet 600 with the swimming pool floor may provide resistance to collapse of inlet 604, upon removal of sealing strip 616 and placement of unitary main drain suction outlet 600 under suction during use.

FIGS. 9A and 9B show top views of installed main drain suction systems having outlets 804 and 806 respectively. Main drain suction outlets 804 have linear sole slot openings disposed substantially within a floor 820 and main drain suction outlets 806 have curved sole slot openings disposed substantially within a floor 820. For example, main drain suction outlets 804 and 806 may be installed substantially parallel with, and spaced from, a wall 801 or 803 of a swimming pool. Main drain suction outlets 806 have a longitudinally curved water inlet and are disposed concentric with a curved wall portion 803 of the swimming pool. Main drain suction outlets 804 have a longitudinally linear water inlet and are disposed parallel with wall 801 of the swimming pool.

A suction outlet system for a swimming pool may comprise a plurality of main drain suction outlets 804 or 806. Main drain suction outlets 804 and 806 may have a configuration similar to main drain outlets 504 and 504*a*, shown in FIG. 5. Main drain suction outlets 804 may be spaced a selected distance "d3" from each other in floor 820 of a swimming pool. For example, main drain suction outlets 804 may be spaced about, or at least, 3 feet or more from each. In at least one embodiment, main drain suction outlets 804 may be spaced about 38 inches, or other distance "d3", that may mitigate hazards associated with main drain suction outlets of the prior art.

Presently disclosed is a suction outlet system for a swimming pool comprising a first main drain and a second main drain. The first main drain, one 804 or 806, comprises: a first water inlet comprising a sole slot opening configured to be disposed substantially flush with a floor 820 of the swimming pool; a first water flow through portion disposed between the first water inlet and a first water exit, the first water flow through portion being void of a sump and configured for the flow through of water from the first water inlet toward the first water exit; and wherein the first water inlet and the first water flow through portion are configured for the flow through of water substantially in a linear direction from the first water inlet toward the first water exit; the second main drain, another 804 or 806, comprising: a second water inlet comprising a sole slot opening configured to be disposed substantially flush with a floor of the swimming pool; a second water flow through portion disposed between the second water inlet and a second water exit, the second water flow through portion being void of a sump and configured for the flow through of water from the second water inlet toward the second water exit; and wherein the second water inlet and the second water flow through portion are configured for the flow through of water substantially in a linear direction from the second water inlet toward the second water exit; and the suction outlet system further comprising a system water exit in flow communication with the first water exit and the second water exit, the system water exit being configured to join with an exit line or pipe.

The system may be configured and disposed to space the first water inlet from the second water inlet from the second water inlet a distance "d3". In at least one embodiment "d3" is at least 3 feet. The first main drain and the second main drain may be in flow communication with one another and a system water exit, for example outlet 500 shown in FIG. 5. The sole slot opening of the first water inlet may have a longitudinal axis parallel with a longitudinal axis of the sole slot opening of the second water inlet as shown in FIG. 5 or FIG. 9A.

Having thus illustrated embodiments of a main drain suction outlet, it is to be understood that the presently claimed main drain suction outlet is not to be limited to the illustrated embodiments. In at least embodiment of the present disclosure, a main drain suction outlet 100 for a swimming pool comprises a water inlet 104 comprising a sole slot opening configured to be disposed substantially flush with a floor of the swimming pool, a water flow through portion 106 disposed between the water inlet and a water exit 110, the water flow through portion being void of a sump and configured for the flow through of water from the water inlet to the water exit. Water exit 110 comprises a rounded opening configured to join with an exit line or pipe. The water inlet and the water flow through portions are configured for the flow through of water substantially in a linear direction from the water inlet toward the water exit, as shown with flow lines "f" in FIG. 1.

Water flow through portion 106 may have a height "h" of at least 6 inches. Water flow through portion 106 may be a concrete form configured for pouring a swimming pool floor thereabout. Unitary main drain suction outlet for a swimming pool 100 may have a flange 112 extending outwardly from the water inlet, flange 112 being configured and disposed to be substantially flush with a floor of the swimming pool. For example, during new construction, a floor may be poured to become in line with flange 112. The main drain outlet of the present disclosure may have a flange extending downwardly from flange 112, for example flange 618 shown in FIG. 8. The downwardly extending flange may cooperate with the poured pool floor and aid in maintaining integrity and placement of the main drain suction outlet in the poured floor.

The sole slot opening may have a length of at least 3 feet, for example 38 inches or about 4 feet. Water flow through portion 106 may have an upper portion, proximate water inlet 104, configured for a flow of water therethrough, toward the water exit, at substantially the same velocity or an increasing velocity, throughout the entire upper portion of the water flow through portion. For example, the cross-sectional area of a portion of water flow through portion 106 may not increase in a length extending from water inlet 104 toward outlet 110. The upper portion of the water flow through portion may be configured for a flow of water therethrough at an increasing velocity toward the water exit. For example, the cross-sectional area of a portion of water flow through portion 106 may be greater proximate water inlet 104 than a cross-sectional area proximate outlet 110.

Water exit 110 may have a flow through axis in-line with a flow through axis of the water inlet and the water flow though portion. Water exit 310 may have a flow through axis perpendicular with a flow through axis of the water inlet and an upper portion of the water flow though portion.

The unitary main drain suction outlet for a swimming pool of the present disclosure may have flow blades 211 in or proximate the water exit. The unitary main drain suction outlet for a swimming pool of the present disclosure may have the water flow through portion comprising a first sidewall and a second sidewall, the first and second sidewalls may each form an equivalent triangular shape with an edge disposed with or proximate the slot opening, as shown in FIG. 1.

The suction outlet system for a swimming pool may have a water exit flow through axis parallel with the longitudinal axes of the sole slot openings of the first water inlet and the second water inlet, as shown in FIG. 4, or it may have a flow through axis perpendicular with the longitudinal axes of the sole slot openings of the first water inlet and the second water inlet. The first water exit and the second water exit may have the same water flow through axis. The first water flow through portion and the second water flow through portion may each have a height of at least 6 inches.

The invention is illustrated by example in the drawing figures, and throughout the written description. It should be understood that numerous variations are possible, for example a variation of the disclosure to serve as a skimmer, while adhering to the inventive concept. Such variations are contemplated as being a part of the present invention.

The invention claimed is:

1. A unitary main drain suction outlet for a swimming pool comprising:

a water inlet comprising a sole slot opening configured to be disposed substantially flush with a floor of the swimming pool;

a water flow through portion disposed between the water inlet and a water exit, the water flow through portion being void of a sump and configured for the flow through of water from the water inlet to the water exit;

the water exit comprising a rounded opening configured to join with an exit line or pipe; and wherein the water inlet and the water flow through portions are configured for the flow through of water substantially in a linear, or non-vortexing, direction from the water inlet toward the water exit.

2. The unitary main drain suction outlet for a swimming pool of claim 1, wherein the water flow through portion has a height of at least 6 inches.

3. The unitary main drain suction outlet for a swimming pool of claim 2, wherein the water flow through portion is a concrete form.

4. The unitary main drain suction outlet for a swimming pool of claim 3 further comprising a flange extending outwardly from the water inlet, the flange being configured and disposed to be substantially flush with a floor of the swimming pool.

5. The unitary main drain suction outlet for a swimming pool of claim 4 further comprising a downwardly extending flange, extending downwardly from the outwardly extending flange and toward the water outlet.

6. The unitary main drain suction outlet for a swimming pool of claim 1, wherein the sole slot opening has a length of at least 3 feet.

7. The unitary main drain suction outlet for a swimming pool of claim 1, wherein the water flow through portion has an upper portion, proximate the water inlet, configured for a flow of water therethrough, toward the water exit, at substantially the same velocity or an increasing velocity, throughout the entire upper portion of the water flow through portion.

8. The unitary main drain suction outlet for a swimming pool of claim 7, wherein the upper portion of the water flow through portion is configured for a flow of water therethrough at substantially a linearly increasing velocity toward the water exit.

9. The unitary main drain suction outlet for a swimming pool of claim 1, wherein the water exit has a flow through axis in-line with a flow through axis of the water inlet and the water flow though portion.

10. The unitary main drain suction outlet for a swimming pool of claim 1, wherein the water exit has a flow through axis perpendicular with a flow through axis of the water inlet and an upper portion of the water flow though portion.

11. The unitary main drain suction outlet for a swimming pool of claim 1 further comprising flow blades in or proximate the water exit.

12. The unitary main drain suction outlet for a swimming pool of claim 1, wherein the water flow through portion comprises a first sidewall and a second sidewall, the first and second sidewalls each form an equivalent triangular shape with an edge disposed with or proximate the slot opening.

13. A suction outlet system for a swimming pool comprising a first unitary main drain and a second unitary main drain;

the first unitary main drain comprises:

a first water inlet comprising a sole slot opening configured to be disposed substantially flush with a floor of the swimming pool;

a first water flow through portion disposed between the first water inlet and a first water exit, the first water flow through portion being void of a sump and configured for the flow through of water from the first water inlet toward the first water exit; and wherein the first water inlet and the first water flow through portion are configured for the flow through of water substantially in a linear direction from the first water inlet toward the first water exit;

the second unitary main drain comprising:

a second water inlet comprising a sole slot opening configured to be disposed substantially flush with a floor of the swimming pool;

a second water flow through portion disposed between the second water inlet and a second water exit, the second water flow through portion being void of a sump and configured for the flow through of water from the second water inlet toward the second water exit; and wherein the second water inlet and the second water flow through portion are configured for the flow through of water substantially in a linear direction from the second water inlet toward the second water exit; and the suction outlet system further comprising a system water exit in flow communication with the first water exit and the second water exit, the system water exit being configured to join with an exit line or pipe.

14. The suction outlet system for a swimming pool of claim 13, wherein the system is configured and disposed to space the first water inlet from the second water inlet at least 3 feet from one another.

15. The suction outlet system for a swimming pool of claim 13, wherein the first unitary main drain and the second unitary main drain are unitary with one another and the system water exit.

16. The suction outlet system for a swimming pool of claim 15, wherein the sole slot opening of the first water inlet has a longitudinal axis parallel with a longitudinal axis of the sole slot opening of the second water inlet.

17. The suction outlet system for a swimming pool of claim 16, wherein the system water exit has a flow through axis parallel with the longitudinal axes of the sole slot openings of the first water inlet and the second water inlet.

18. The suction outlet system for a swimming pool of claim 13, wherein the first water exit and the second water exit have the same water flow through axis.

19. The suction outlet system for a swimming pool of claim 13, wherein the first water flow through portion and the second water flow through portion each have a height of at least 6 inches.

20. A unitary suction outlet for a swimming pool comprising:

a unitary concrete form having a first sidewall and a second sidewall;

the first sidewall being spaced from the second sidewall;

the first sidewall and the second sidewall having edges joined together, forming a water flow through portion having sole slot inlet therebetween;

an exit in flow communication with the sole slot inlet and the water flow through portion;

the sole slot inlet and the water flow through portion being configured and disposed to provide a substantially non-vortexing flow of water from a floor of the swimming pool, upon a suction being placed on the water flowing through the suction outlet; and at least one flange extending from the sidewalls configured to become embedded in a poured concrete floor of the swimming pool.

* * * * *